US008317061B2

(12) United States Patent
Vignot

(10) Patent No.: US 8,317,061 B2
(45) Date of Patent: Nov. 27, 2012

(54) WIPE DISPENSING DEVICE

(75) Inventor: Eric Vignot, Croissy Beaubourg (FR)

(73) Assignee: Laboratories Prodene-Klint, Croissy Beaubourg (FR)

( * ) Notice: Subject to any disclaimer, the term of this patent is extended or adjusted under 35 U.S.C. 154(b) by 0 days.

(21) Appl. No.: 12/812,611

(22) PCT Filed: Jan. 8, 2009

(86) PCT No.: PCT/FR2009/050017

§ 371 (c)(1),
(2), (4) Date: Aug. 10, 2010

(87) PCT Pub. No.: WO2009/092935

PCT Pub. Date: Jul. 30, 2009

(65) Prior Publication Data

US 2010/0294792 A1 Nov. 25, 2010

(30) Foreign Application Priority Data

Jan. 16, 2008 (FR) ..... 08 00230

(51) Int. Cl.
*B65D 83/08* (2006.01)

(52) U.S. Cl. ..... 221/45; 221/61; 221/62; 221/46; 221/63

(58) Field of Classification Search ..... 221/33–63
See application file for complete search history.

(56) References Cited

U.S. PATENT DOCUMENTS

| | | | | |
|---|---|---|---|---|
| 3,982,659 | A * | 9/1976 | Ross | 221/63 |
| 4,735,317 | A * | 4/1988 | Sussman et al. | 206/449 |
| 5,704,471 | A * | 1/1998 | Yamada | 206/207 |
| 7,140,492 | B2 * | 11/2006 | Julius | 206/494 |
| 7,416,083 | B2 * | 8/2008 | Bando | 206/494 |
| 2010/0032445 | A1 * | 2/2010 | Bunoz | 221/45 |

FOREIGN PATENT DOCUMENTS

| | | |
|---|---|---|
| DE | 38 39 180 C1 | 1/1990 |
| EP | 1 607 033 A1 | 12/2005 |
| EP | 1 707 092 A1 | 10/2006 |

OTHER PUBLICATIONS

International Search Report, dated Aug. 5, 2009, from corresponding PCT application.

* cited by examiner

*Primary Examiner* — Michael K Collins
(74) *Attorney, Agent, or Firm* — Young & Thompson

(57) ABSTRACT

A device includes a housing (100) in which is placed a bag (400) containing wipes, and having an extraction opening for the wipes. The housing (100) includes a front cover (102) mounted on a rear wall (101), and the front cover (102) has a wipe outlet opening (20) and bears a lid (3) covering the wipe outlet opening (20) in the closed position. The bag (400) is carried by a coupling plate (4) placed inside the housing (100) under the wipe outlet opening (20) of the front cover (102).

9 Claims, 4 Drawing Sheets

WIPE DISPENSING DEVICE

BACKGROUND OF THE INVENTION

The present invention relates in general to devices for dispensing cleaning elements such as wipes, and more particularly to such a device intended to be used for moist wipes.

DESCRIPTION OF THE PRIOR ART

In general, the use of cleaning means in the form of disposable wipes has been expanding over several years. The term wipe denotes small towels, often made of non-woven cellulose, the size of which is suited to allow for practical use but limited to one single use.

Many types of moist wipe, that is to say wipes impregnated with a liquid, are on offer, to make said liquid easier to use. These wipes free the user of the need to find a support such as cotton wool, a dressing or a cloth, onto which to pour the liquid before using it. Such wipes are, for example, offered for pharmaceutical use, being impregnated with an antiseptic solution, an alcohol, etc., for cosmetic use, being impregnated with makeup removing lotions, care lotions, etc., or alternatively in the field of household products, being impregnated with cleaning products, polish, etc.

The wipes are usually packaged into a packet comprising an orifice through which said wipes can be extracted.

The extraction orifice is closed by a repositionable sticky label so that the wipes can be used from said packet and the extraction orifice can be closed again after each use. Use of the repositionable label is intended to prevent the wipes still in the packet from drying out. However, it is found that in many cases, the repositionable label no longer sticks very firmly to the surface of the packet after a few uses, which means that the extraction orifice remains open, at least in part, causing the liquid with which the wipes are impregnated to evaporate and the wipes to dry out.

To alleviate this problem, dispensing devices generally consisting of a housing in which the packet of wipes is positioned have been proposed. Said housing comprises an outlet orifice closed by a lid. The packet of wipes is placed in said housing, after the repositionable label has been removed, positioning the wipe extraction opening under the outlet orifice.

Numerous dispensing devices of this type are known and have been marketed for many years, but it has been found that none is entirely satisfactory because the positioning of the packet of wipes in the housing is somewhat impractical both in terms of its placement and in terms of its use, the wipes drying out, being awkward to grasp, etc.

In addition, when the wipes come as a web which may or may not be precut, it is often somewhat awkward to separate off one wipe so that it can be used.

Another problem that arises is that of returning the end of a first wipe which has retracted back inside the packet to its rightful place in the outlet opening.

There are also devices like the one described in US 2004/035738, in which the packet containing the wipes is equipped with a closure device positioned over the wipes outlet orifice. Such a closure device comprises a flap that can be closed so that the packet of wipes can be used on its own without the risk of the wipes drying out.

Said packet can also be positioned in the carrier of a dispensing device. To do that, the closure device is designed so that it can be secured to the carrier through the collaboration of grooves and ribs borne by said closure device of the packet of wipes and by said carrier.

Such a device entails the use, on each packet of wipes, of a closure device over the wipes outlet orifice. It is therefore fairly expensive.

SUMMARY OF THE INVENTION

The present invention attempts to provide a device for dispensing moist wipes that does not have these disadvantages.

To this end, the invention relates to a device for dispensing wipes, consisting of a housing in which there is placed a packet containing wipes and having an orifice through which said wipes can be extracted, wherein said housing comprises a front cover mounted on a rear wall, wherein said front cover has a wipes outlet orifice and bears a lid which, in its closed position, covers said wipes outlet orifice, and wherein said packet is supported by a coupling plate positioned in said housing under said wipes outlet orifice in the front cover.

The wipes dispensing device according to the invention is further notable in that:

- the coupling plate is made up of a flat central part through which there passes an aperture, and of tabs via which it is supported by the housing,
- one of the tabs positions the coupling plate on an upper coupling lug positioned in the upper part of the housing,
- at least one tab positions the coupling plate on a positioning lug in register therewith and belonging to the housing,
- the coupling plate comprises three tabs, a central tab positioning the coupling plate on an upper coupling lug and two lateral tabs positioning the coupling plate on positioning lugs, said tabs overall being positioned 120° apart along the periphery of said central part of said coupling plate,
- the central tab bears a first retaining lug arranged along its free end and extending at right angles to its underside facing toward the packet and a second retaining lug arranged on its underside and extending at an angle toward said first retaining lug,
- the coupling plate is positioned on the rear wall of the housing,
- the coupling plate is positioned parallel to the orifice in the front cover in its position in which the housing is closed,
- the aperture in the coupling plate is shaped in such a way as to be able to cut the wipes, the lower part of the aperture being closed off over approximately 120° by a tab the central part of which is in the form of a funnel made up of two oblique walls that converge toward one another and end in a slit,
- the lid bears a cylindrical end piece on its face that faces toward the orifice, said end piece having a cross section that allows it to be inserted into said orifice,
- the free end of said cylindrical end piece carries a seal which presses against the coupling plate, around the aperture therein, when the lid is closing the housing,
- the packet supports the coupling plate, positioned above its extraction orifice,
- the packet comprises a second opening positioned in a region of the wall of said packet that faces the extraction orifice covered by the coupling plate.

BRIEF DESCRIPTION OF THE DRAWINGS

The invention will be better understood from the following description given by way of nonlimiting example with reference to the attached drawings in which.

DESCRIPTION OF THE PREFERRED EMBODIMENTS

Figure 1:
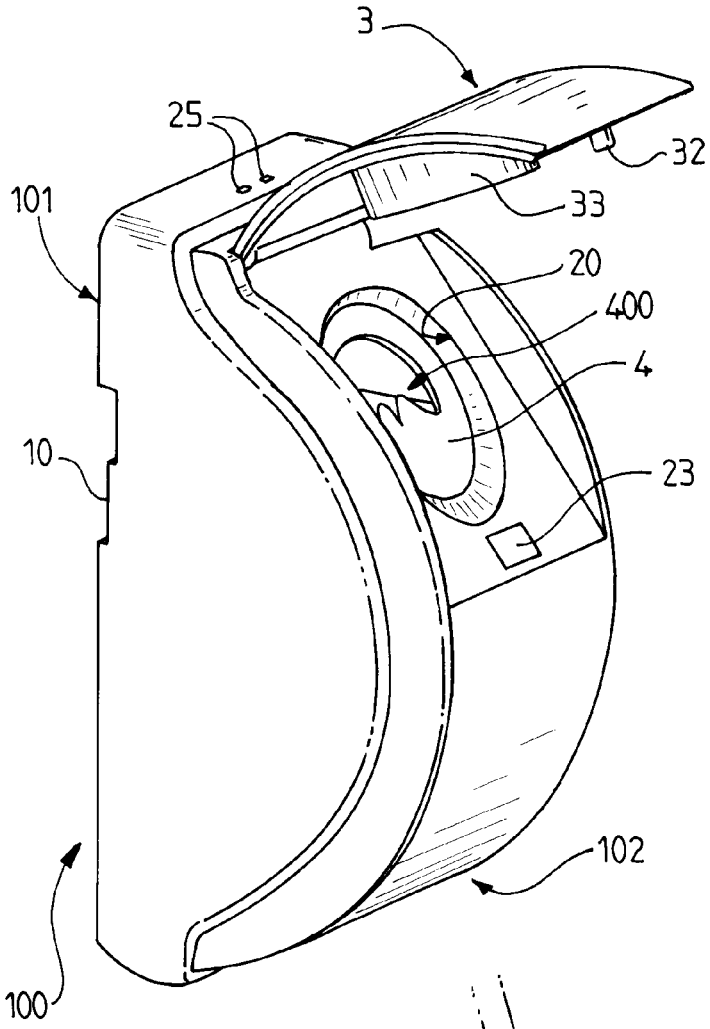
FIG. 1 is a perspective view of a dispensing device according to the invention with the lid open.
Figure 3:
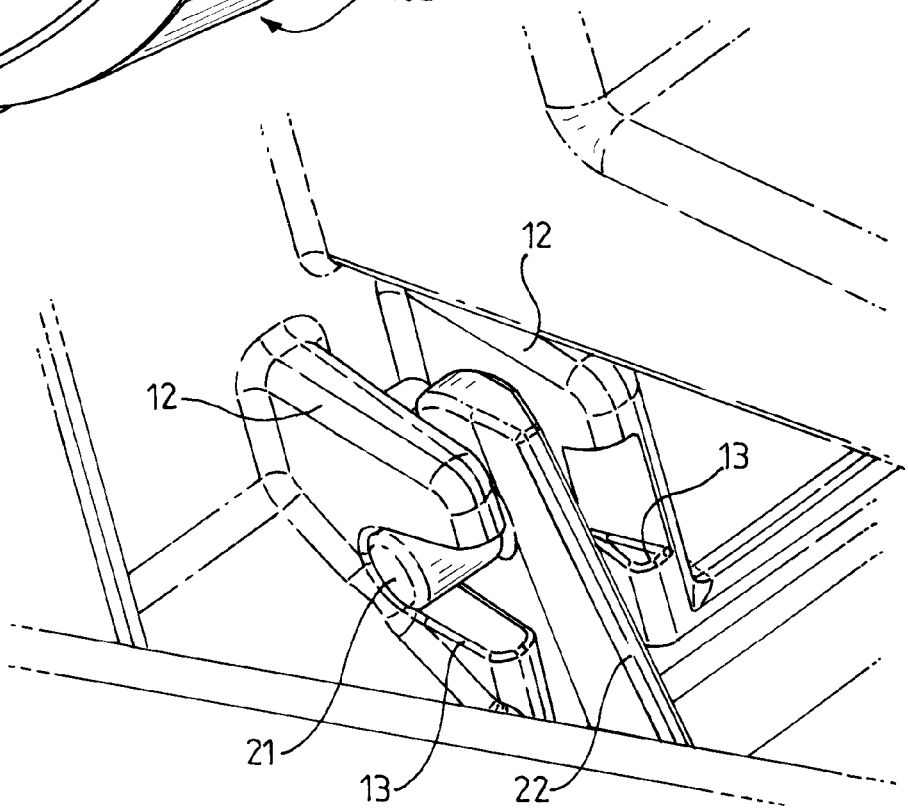
FIG. 3 is a larger-scale perspective view of the inside of the dispensing device with the front cover open, showing one of the means for mounting the front cover on the rear wall.

The dispensing device according to the invention is, as is known per se, made up of a housing 100 in which a packet 400 containing wipes is positioned.

The housing 100 comprises a front cover 102 mounted on a rear wall 101 and supporting a mobile lid 3.

Figure 2:
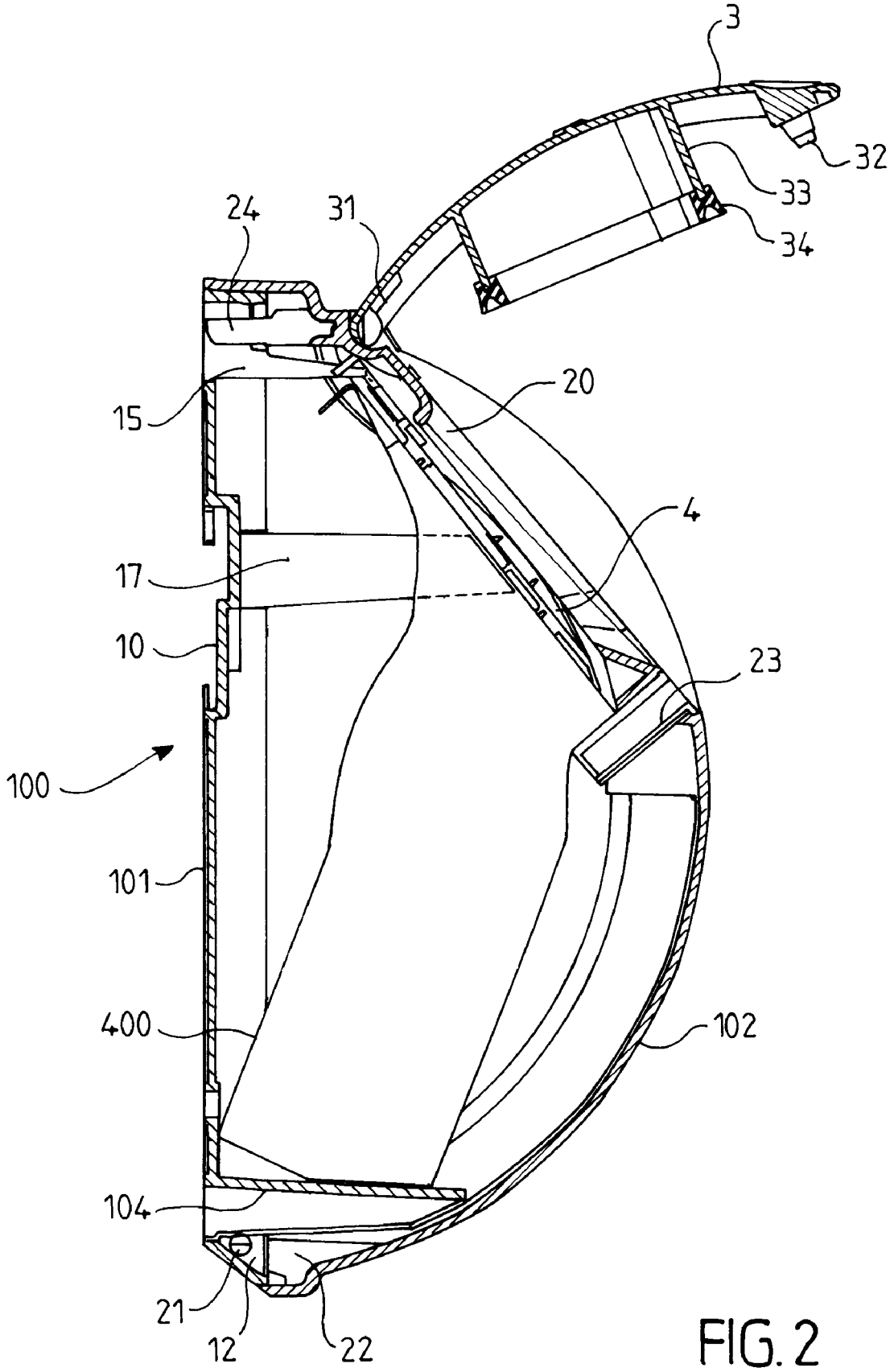
FIG. 2 is a sectioned side view of the dispensing device of FIG. 1.

Said lid 3 is able to rotate about an axis via which it is mounted on the front cover 102, between a position (FIG. 5) in which a wipes outlet orifice 20 in said cover 102 communicating with the inside of the housing 100 is closed, and a position (FIGS. 1 and 2) in which this orifice is open.

The lid 3 is kept in the position in which the orifice 20 in the front cover 102 is closed by means 23 known per se and which will not be described further in detail.

Said closure means 23 are, for example, means normally known as "push-pull" means positioned in the front cover 102 and collaborating with the hook 32 of the lid, which are operated by pressing on the lid 3, in the region thereof positioned above said hook 32.

Pressing on the lid 3 in the closed position releases the latch and allows said lid 3 to open; likewise, pressing on the lid 3 which is open, but resting against the front cover 102, locks said lid in the closed position.

Elastic means 31 such as coil springs cause the lid 3 to rotate into its open position when the closure means 23 are unlatched.

Use of such so-called "push-pull" closure means allows the user to ensure in an easy way that the housing is properly closed. Indeed, if not closed properly, the lid will open under the action of the elastic means and a simple glance will reveal that the housing is open, whereas when the lid is closed simply by means of the user folding it down or by elastic means that return it to a closed position, it is necessary to press on said lid to ensure that it is properly closed.

The rear wall 101 is flat overall. It is intended to be attached to a wall, either by being hung from a rail by means of the cutout 10, or by being positioned on fasteners such as screws, via the openings 11.

The front cover 102 is mounted such that it can rotate on the rear wall 1. For this, in the exemplary embodiment depicted in the drawing, the rear wall 1 in its lower part and near each of its lateral edges, bears a set of two lugs 12 which are perpendicular to its plane and parallel to one another. Each lug 12 has a notch 13 in which a pin 21 carried by an arm 22 of the front cover 102 is positioned. The interior wall of said front cover 102 bears two arms 22 arranged in such a way that they can be positioned parallel to said lugs 12 of the rear wall and between the latter, and each equipped with two pins 21.

When the housing 100 is closed, the front cover 102 is rotated about the pins 21 then at least one lug 24 positioned near the upper end of said front cover 102 is inserted into the orifice 14 in the rear wall 101.

In a way known per se, each lug 24 ends in a stud, not visible in the drawing, which comes to press against the rear face of said rear wall 101 to keep said front cover 102 in the position in which the housing 100 is closed. Through-orifices 25 formed in the upper face of the front cover 102 allow the insertion of means known per se and not depicted in the drawing for pushing said stud back toward the inside of the orifice 14 so that the housing 100 can be opened.

The housing 100 is intended to enclose a packet 400 containing a roll of wipes.

For this, according to the invention, a coupling plate 4 holds and positions said packet 400 inside said housing 100.

The coupling plate 4 is made up of a flat central part 40 through which there passes an aperture 41, and of tabs via which it is supported by the housing 100.

In the exemplary embodiment depicted in the drawing, the coupling plate comprises three tabs, one central tab 45 and two lateral tabs 48, arranged overall at 120° apart along the periphery of said central part 40.

The central tab 45 bears two retaining lugs 46 and 47. The first retaining lug 46 is arranged along the free end of the central tab 45, and extends at right angles to the underside of the coupling plate 4, that is to say the face facing toward the packet 400. The second retaining lug 47 is arranged on the underside of the coupling plate 4 and extends at an angle toward said first retaining lug 46.

The central tab 45 is hollowed out so that it can be manufactured using molding, promoting the achieving of precise dimensions and reducing the amount of material required.

Figure 4:
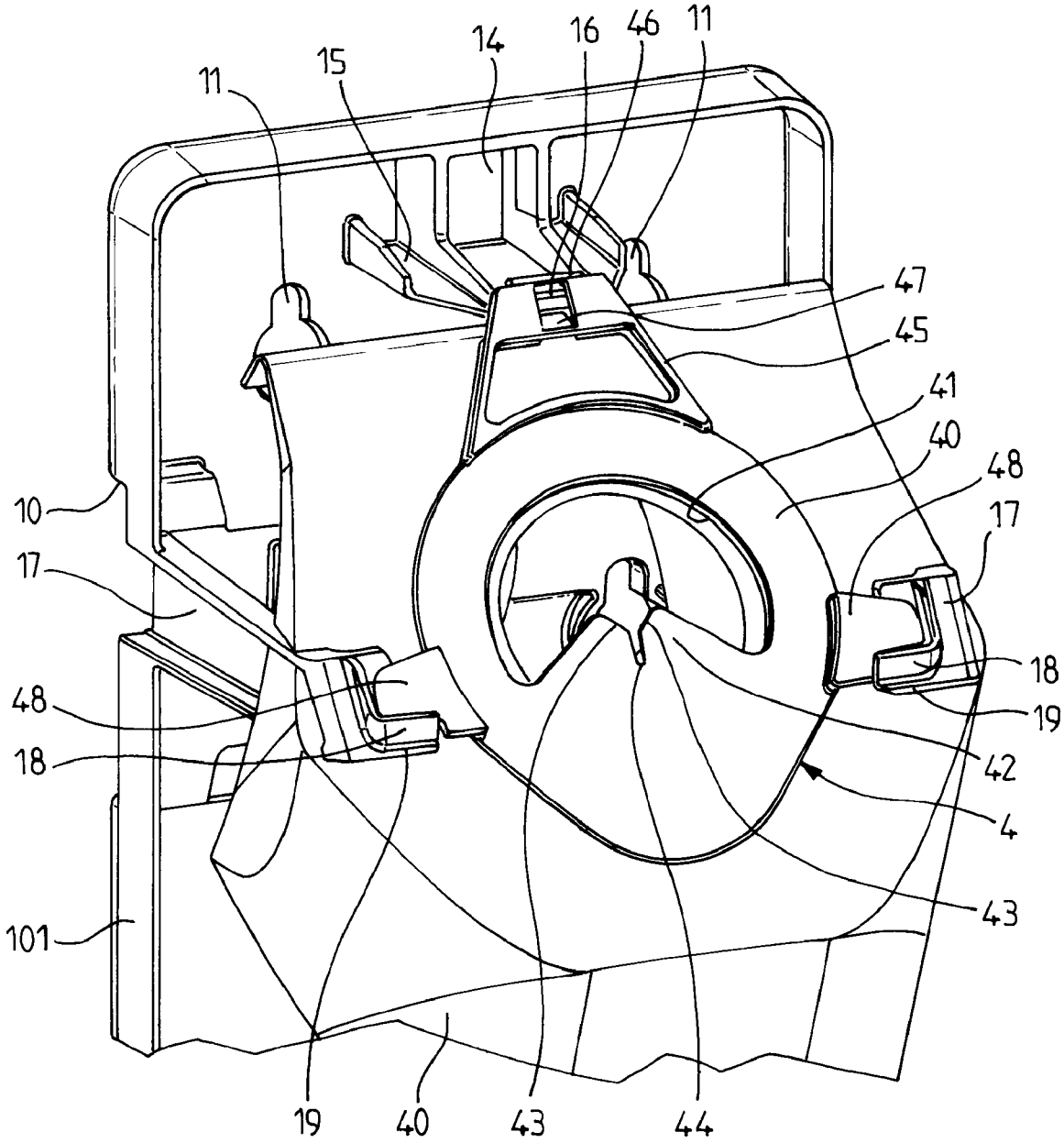
FIG. 4 is a view of the upper part of the dispensing device with the front cover open.
Figure 5:
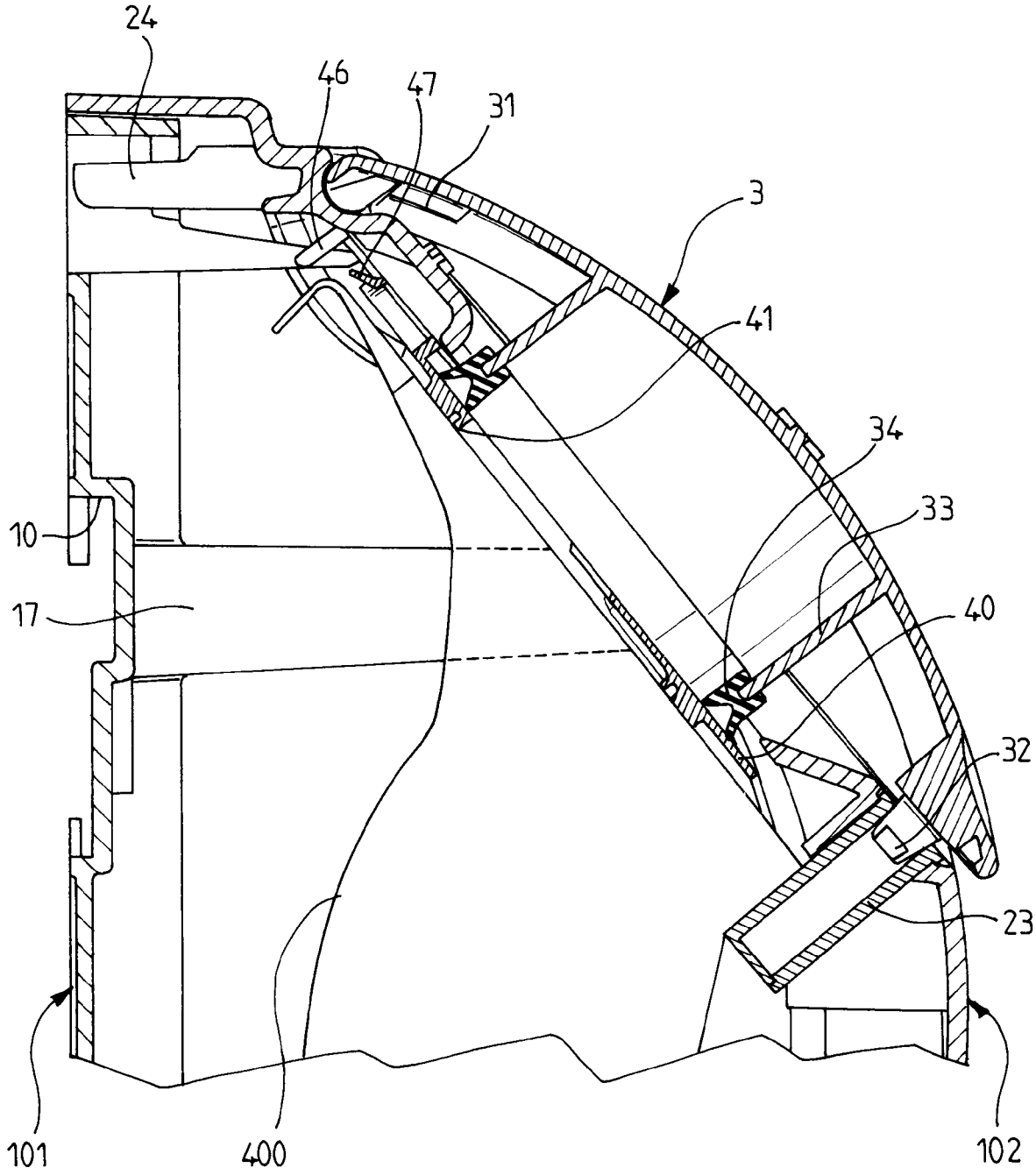
FIG. 5 is a sectioned side view of the dispensing device with the lid closed, confined to the upper part of said dispensing device.

As can be seen in the drawing, especially in FIGS. 4 and 5, the central tab 45 positions the coupling plate 4 on a rib 6 provided at the end of an upper coupling lug 15 positioned in the upper part of the housing 100.

In the exemplary embodiment depicted in the drawing, said upper coupling lug is borne by the rear wall 101 of the housing 100, near the upper edge thereof.

The coupling plate 4 is supported by the upper coupling lug 15 with the first retaining lug 46 arranged above the upper coupling lug 15 and on that side of the rib 16 that faces toward the rear wall 101, and the second retaining lug 47 arranged under the upper coupling lug 15.

The two lateral tabs 48 extend, in the exemplary embodiment depicted in the drawing, generally in the same direction, their lower edges distant from the central tab 45 generally running along one and the same line parallel to the plane of the first retaining lug 46.

The rear wall 101 bears two positioning lugs 17 ending in flat ends 19 bearing an L-shaped rib 18.

The two L-shaped ribs 18 borne by the flat ends 19 face one another and with said flat ends define housings in which the lateral tabs 48 of the coupling plate 4 can be positioned.

The dimensions, positions and orientations of the upper coupling lug 15 and of the positioning lugs 17 are determined such that the coupling plate 4 is positioned parallel to the wipes outlet orifice 20 in the front cover 102 when this cover is in its position in which the housing 100 is closed, and very close to the lower edge of said orifice 20, preferably resting against the latter.

In the exemplary embodiment depicted in the drawing, said positioning lugs 17 are also borne by the rear wall 101 of the housing.

The arrangement depicted, whereby the coupling plate 4 is supported by the rear wall 101 of the housing, makes the packet 400 of wipes easier to set in place when the front cover 102 has been folded down to open up the housing 100.

In use, the dispensing device according to the invention comprises a packet 400 containing wipes. Said packet is stuck to the lower wall, facing toward the rear wall 101, of the coupling plate 4, with its extraction orifice under the aperture 41.

It is possible to stick the packet 400 full of wipes under the coupling plate 4 after the repositionable label has been removed, when placing the packet in the housing.

For preference, the packets 400 intended to be used in the dispensing device of the invention each have a coupling plate 4 the aperture 41 of which is closed off by a removable sticky label which is removed at the time of placement in the housing 100.

The aperture 41 in the coupling plate 4 is shaped in such a way as to be able to cut the wipes. For this, the lower part of the aperture 41 is closed off over approximately 120° by a tab 42 the central part of which is in the form of a funnel made up of two oblique walls 43 that converge toward one another ending in a slit 44.

Such an arrangement allows the wipe to be slid along the radial free edges of the tab 42 to bring it into the funnel shape and then into the end of the slit where it becomes wedged, making it easier to cut.

The rear wall 101 also carries a panel 104 against which the bottom of the packet 400 can be positioned so that the coupling plate 4 and the means supporting it do not have to support the entire weight of the packet.

According to one advantageous embodiment that is not visible in the drawing, the packet 400 comprises a second opening, closed by a repositionable label, arranged in a region of the wall of said packet 400 that faces the extraction orifice covered by the coupling plate 4.

This second opening makes it easy to reach the first wipe and position it in the aperture 41 in the coupling plate 4. This operation is easier to perform with such a second opening than it is in the known dispensing devices where it is necessary to reach the wipe through the extraction orifice fitted with a wipe cutting means.

The lid 3 of the dispensing device according to the invention bears a cylindrical end piece 33 on its face facing toward the wipes outlet orifice 20. The cross section of the end piece 33 is of a shape suited to being able to be inserted in the orifice 20 and surround the aperture 41 in the coupling plate 4.

The end of a wipe protruding from the coupling plate 4 ready for next use is enclosed in said cylindrical end piece 33 when the lid 3 is closed, to prevent it from drying out.

The free end of said cylindrical end piece 33 bears a seal 34 which presses against the coupling plate 4, around the aperture 41 therein, when the lid 3 is closing the housing 100.

This arrangement ensures that the packet 400 is hermetically sealed, making it possible to avoid the abovementioned problems of wipes drying out.

The invention claimed is:

1. A device for dispensing wipes, consisting of a housing in which there is placed a packet containing wipes, said housing having an orifice through which said wipes can be extracted, said housing comprising a front cover and a rear wall, a coupling plate being positioned on the rear wall of the housing, wherein said front cover has a wipes outlet orifice and bears a lid which, in a closed position for closing the housing, covers said wipes outlet orifice, the coupling plate being positioned parallel to the orifice of the front cover when the housing is closed, wherein said packet is supported by the coupling plate under said wipes outlet orifice in the front cover, wherein the coupling plate comprises a flat central part through which there passes an aperture, wherein the coupling plate further comprises a central tab positioning the coupling plate on an upper coupling lug positioned in an upper part of the housing, and two lateral tabs positioning the coupling plate on positioning lugs in register therewith and located on the housing, said central tab and said lateral tabs being positioned 120° apart along a periphery of said central part of said coupling plate, and wherein a free end of the central tab bears a first retaining lug extending at right angles to an underside of the central tab that faces toward the packet, and the central tab also has a second retaining lug arranged on said underside and extending at an angle toward said first retaining lug.

2. The device as claimed in claim 1, wherein the aperture in the coupling plate is shaped in such a way as to be able to cut the wipes, the lower part of the aperture being closed off over approximately 120° by a tab the central part of which is in the form of a funnel made up of two oblique walls that converge toward one another and end in a slit.

3. The device as claimed in claim 1, wherein a face of the lid facing toward the orifice bears a cylindrical end piece, said end piece having a cross section that allows the end piece to be inserted into said orifice.

4. The device as claimed in claim 3, wherein the free end of said cylindrical end piece carries a seal which presses against the coupling plate, around the aperture therein, when the lid is closing the housing.

5. The device as claimed in claim 1, wherein the packet supports the coupling plate, positioned above its extraction orifice.

6. The device as claimed in claim 1, wherein the packet comprises a second opening positioned in a region of the wall of said packet that faces the extraction orifice covered by the coupling plate.

7. A device for dispensing wipes, comprising:

a housing configured to receive a packet containing wipes, said housing comprises a front cover and a rear wall, the rear wall having a coupling plate positioned thereon and the front cover having a wipes outlet orifice, wherein said front cover bears a lid which, in a closed position for closing the housing, covers said wipes outlet orifice, wherein the coupling plate, when the lid is in the closed position, is positioned parallel to the orifice of the front cover, wherein the coupling plate is configured to support the packet under said wipes outlet orifice, wherein the coupling plate comprises a flat central part having an aperture extending therethrough, wherein the coupling plate further comprises a central tab for connecting the coupling plate to an upper coupling lug located on an upper part of the housing, and two lateral tabs in register with positioning lugs of the housing thereby for positioning the coupling plate on said positioning lugs, said central tab and said lateral tabs being positioned 120° apart from each other along a periphery of said central part, and wherein a free end of the central tab bears a first retaining lug extending perpendicularly to an underside of the central tab that faces toward the packet, and the central tab also includes a second retaining lug arranged on the underside and extending at an angle toward said first retaining lug.

8. The device as claimed in claim 7, wherein a face of the lid facing toward the orifice bears a cylindrical end piece, said end piece being dimensioned to fit into said orifice.

9. The device as claimed in claim 7, wherein the coupling plate includes a cutting tab that forms a lower part of the aperture, a central part of said tab shaped as a funnel including two oblique walls that converge toward one another and end in a slit.

* * * * *